US007241416B2

(12) United States Patent
Sweetland

(10) Patent No.: US 7,241,416 B2
(45) Date of Patent: Jul. 10, 2007

(54) METAL INJECTION MOLDED TURBINE ROTOR AND METAL INJECTION MOLDED SHAFT CONNECTION ATTACHMENT THERETO

(75) Inventor: Patrick Sweetland, Candler, NC (US)

(73) Assignee: Borg Warner Inc., Auburn Hills, MI (US)

( * ) Notice: Subject to any disclaimer, the term of this patent is extended or adjusted under 35 U.S.C. 154(b) by 335 days.

(21) Appl. No.: 10/639,314

(22) Filed: Aug. 12, 2003

(65) Prior Publication Data

US 2005/0036898 A1 Feb. 17, 2005

(51) Int. Cl.
*B22F 7/00* (2006.01)

(52) U.S. Cl. ..... 419/8; 419/6

(58) Field of Classification Search ..... 419/5, 419/6, 8; 416/213 R, 244 A; 428/553
See application file for complete search history.

(56) References Cited

U.S. PATENT DOCUMENTS 3,665,585 A * 5/1972 Dunn et al. ..... 419/6
4,096,615 A * 6/1978 Cross ..... 29/889.21
4,595,556 A * 6/1986 Umeha et al. ..... 419/8
4,602,952 A * 7/1986 Greene et al. ..... 75/228
4,680,160 A * 7/1987 Helmink ..... 419/6
4,907,947 A * 3/1990 Hoppin, III ..... 416/241 R
5,064,112 A * 11/1991 Isobe et al. ..... 228/112.1
5,314,106 A * 5/1994 Ambroziak et al. ..... 228/114.5
5,395,699 A * 3/1995 Ernst et al. ..... 428/547
5,431,752 A * 7/1995 Brogle et al. ..... 148/516
5,554,338 A * 9/1996 Sugihara et al. ..... 419/5
5,746,960 A * 5/1998 Kasai et al. ..... 264/234
6,164,931 A * 12/2000 Norton et al. ..... 417/407
6,291,086 B1 * 9/2001 Nguyen-Dinh ..... 428/660
6,478,842 B1 * 11/2002 Gressel et al. ..... 75/246
6,551,551 B1 * 4/2003 Gegel et al. ..... 419/5
7,052,241 B2 * 5/2006 Decker ..... 416/213 R

FOREIGN PATENT DOCUMENTS

JP 2004090130 A * 3/2004
WO WO87/06863 * 11/1987

* cited by examiner

*Primary Examiner*—Roy V. King
*Assistant Examiner*—Nicholas A. Smith
(74) *Attorney, Agent, or Firm*—Akerman Senterfitt; Stephan A. Pendorf; Greg Dziegielewski

(57) ABSTRACT

A rotor shaft assembly (101) of a type used in a turbocharger, manufactured by mounting a powder compact of a titanium aluminide rotor (203) to a powder compact of a steel shaft (207), with a metal powder admixed with a binder (211) interposed between the rotor and shaft, and debinding and sintering the mounted compact combination. Sintering produces a strong metallurgical bond between the shaft and rotor, providing a near-net rotor shaft assembly (101) and also an inexpensive and efficient method for the manufacture of an assembly capable of withstanding the high forces and temperatures within a turbocharger.

8 Claims, 3 Drawing Sheets

METAL INJECTION MOLDED TURBINE ROTOR AND METAL INJECTION MOLDED SHAFT CONNECTION ATTACHMENT THERETO

FIELD OF THE INVENTION

The present invention relates to a rotor shaft assembly of a type used in an exhaust driven turbocharger to drive a compressor and provide compressed air to an internal combustion engine, and to a method for the manufacture of the rotor shaft assembly. Specifically, the invention relates to a rotor shaft assembly for a turbocharger comprising a titanium aluminide turbine rotor axially joined to a steel shaft by a strong metallurgical bond, and to a method for its manufacture. More specifically, the invention relates to a novel method for the axial attachment of a titanium aluminide turbine rotor to a steel shaft in which a powder compact of a rotor and a powder compact of a shaft are debound and sintered in a mounted configuration.

DESCRIPTION OF THE RELATED ART

Turbochargers are widely used in internal combustion engines to increase engine power and efficiency, particularly in the large diesel engines of highway trucks and marine engines. Recently, turbochargers have become increasingly popular for use in smaller, passenger car engines. The use of a turbocharger permits selection of a power plant that develops a required number of horsepower from a lighter engine. The use of a lighter engine has the desirable effect of decreasing the mass of the car, thus enhancing fuel economy and increasing sports performance. In addition, the use of a turbocharger permits more complete combustion of the fuel delivered to the engine, which reduces hydrocarbon and NOx emissions, thereby contributing to the highly desirable goal of a cleaner atmosphere.

Turbochargers generally comprise a turbine housing that directs exhaust gases from an exhaust inlet to an exhaust outlet across a turbine rotor. The turbine rotor drives a shaft, which is journaled in a bearing housing section. A compressor rotor is driven on the other end of the shaft, which provides pressurized gas to the engine inlet.

The general design and function of turbochargers are described in detail in the prior art, for example, U.S. Pat. Nos. 4,705,463; 5,399,064; and 6,164,931, the disclosures of which are incorporated herein in their entireties by reference.

To improve the heat resistance of the turbocharger, and to enhance engine responsiveness to changing operating conditions by lowering the inertia of the turbine rotor, ceramic turbine rotors made of silicon nitride are known in the art. However, ceramic turbine rotors have drawbacks: the rotors must be thicker than those of conventional metal rotors because of the lower rigidity of ceramics. Also, balancing the thermal expansion of the ceramic rotor and its metal casing to maintain required clearances is difficult because of the much lower thermal expansivity of ceramics.

Titanium aluminide (TiAl) is preferred to ceramic as a material for the manufacture of turbine rotors because of its low specific gravity of approximately 3.8; high specific strength (strength by density) at high temperatures, which is equal to or better than that of Inconel 713° C.; and a thermal expansion coefficient close to that of other metals. For these reasons, TiAl is now known in the art for the manufacture of turbine rotors (e.g. Japanese Patent Disclosure No. 61-229901, and U.S. Pat. Nos. 6,007,301; 5,064,112; 6,291,086; and 5,314,106). Titanium alloys are also known for use in turbine rotors, including alloys comprising a TiAl intermetallic compound as the main component and other non-titanium elements in lesser amounts. In the following description, all such alloys are generically referred to as TiAl. Both because of its expense, and to minimize the inertia of the rotor, TiAl rotors are preferably manufactured from the minimum of material.

Increasingly, powder metal processes are used to manufacture rotors and other parts that have a complex geometry. Metal injection molding of a metal powder admixed with a binder produces a "compact," which is debound and sintered to yield a near-net part. The method provides inexpensive high-volume production, and is applicable to both the rotor and shaft of a turbine rotor assembly. See U.S. Pat. No. 6,478,842 to Gressel et al. A further level of sophistication can be achieved by metal injection molding components with different metal powders injected into different parts of the mold. See U.S. Patent Pub. No. US2003/0012677 to Senini.

To manufacture a turbine rotor assembly comprising a TiAl turbine rotor, the rotor is bonded to a shaft that is typically made of a structural steel. In the case of turbine rotors made of the well-known Ni-based superalloy, Inconel 713° C., a suitably strong bond between shaft and rotor is achieved by friction welding or electron-beam welding.

In contrast, achieving a suitably strong bond between TiAl and a steel shaft is very difficult and this has limited the use of TiAl rotors in production because of the additional expense and steps required to achieve a strong bond. Direct friction welding is ineffective for mounting a TiAl turbine rotor to a steel shaft because transformation of the structural steel from austenite to martensite when the shaft steel is cooled causes a volume expansion of the steel, which results in high residual stresses at the joint. This difficulty is compounded by the large difference between the melting points of steel and TiAl, and the very different metallurgy of the two alloys. Even though TiAl has high rigidity, its ductility at room temperature is low (about 1%), and so TiAl rotors readily crack due to residual stresses. In addition, during heating and cooling, titanium reacts with carbon in steel to form titanium carbide at the bonding interface, resulting in a weaker bond.

Securely attaching a TiAl rotor to a steel shaft, or to any metallic shaft is difficult because the bond must be able to withstand the severe elevated and fluctuating temperatures that are found within an operating turbocharger. In addition, the bond must also withstand high circumferential loads due to centrifugal forces due to the transmission of relatively high and fluctuating torques. It has therefore proved almost impossible to provide a particularly positive, intimate joint to connect a TiAl rotor to a steel shaft without an intermediate material of different composition.

To connect a TiAl rotor to a steel shaft it is known to interpose an austenitic material that does not suffer from martensitic transformation. A first bond, typically a weld, is required between the interposed material and the turbine rotor, and a second bond, also typically a weld, is required to attach the rotor to the shaft via the interposed material. These extra steps add time and expense to the manufacture of a turbine rotor assembly. Furthermore, controlling the final thickness of the interposed material is difficult.

As one example, U.S. Pat. No. 5,431,752 to Brogle et al. discloses the use of a nickel alloy piece interposed between a γ-TiAl rotor and a steel shaft, in which the interposed piece is sequentially bonded to the shaft and rotor by friction welding.

In a second example, U.S. Pat. No. 5,064,112 to Isobe et al. discloses the use of an austenitic stainless steel, or a Ni-based or Co-based superalloy interposed between a structural steel and a TiAl member to achieve a strong friction weld between them.

In a third example, U.S. Pat. No. 6,291,086 to Nguyen-Dinh disloses the use of an intermediate iron-based interlayer to attach steel and TiAl members.

In a fourth example, U.S. Pat. No. 5,3114,106 to Ambroziak et al. teaches two intermediate interlayers of copper and vanadium to attach steel and TiAl members. All four of the above examples suffer from the drawbacks of additional steps, additional expense, and reduced dimensional accuracy.

It is also known to employ vacuum brazing of the rotor to the shaft, as disclosed in Japanese Patent Disclosure No. 02-133183. However, the vacuum brazing method suffers from the drawback that the brazing must be performed under a high vacuum, which is time consuming and expensive. In addition, achieving a reliable strong bond by this method may be problematic.

It is known to join metal injection molded sprockets gears and cams by sintering the green powder compacts in an assembled state, as disclosed in U.S. Pat. No. 5,554,338. This method relies upon solid-state diffusion of the metal particles at the jointing surface during sintering to provide a bond. However, the method suffers from the dual drawbacks that the metals of the two compacts must be compatible, and the rough surfaces of the compacts provide relatively few points of contact, which reduces the strength of the bond. This method has apparently not been used to provide a sufficiently strong bond between a rotor and shaft of a rotor shaft assembly to operate under the demanding conditions of a turbocharger.

It is also known to join planar surfaces of metal injection molded compacts by providing an intervening layer of a bonding agent comprising a metal powder and a binder. See U.S. Pat. No. 6,551,551. This method alone has apparently not provided a bond of sufficient strength to bond a TiAl rotor and steel shaft of a turbocharger rotor shaft assembly.

There is therefore a need in the art for a method to attach a TiAl rotor to a shaft made of structural steel or other material for the economical manufacture of a rotor shaft assembly. The bond between the rotor and shaft must be sufficiently strong to withstand high fluctuating torques and temperatures, and is preferably formed by a method requiring the minimum of steps and expense. The present invention provides these advantages and more, as will become apparent to one of ordinary skill upon reading the following disclosure and figures.

SUMMARY OF THE INVENTION

In a broad aspect, the invention seeks to overcome the disadvantages of the aforementioned prior art and provide a turbine rotor assembly having a strong bond between a TiAl turbine rotor and a steel shaft. The invention provides a metallurgical bond that ensures an intimate positive union of the rotor and shaft that is capable of withstanding the high and fluctuating temperatures found in an operating turbocharger. Furthermore, the invention provides a bond that is able to sustain the connection in view of the centrifugal forces encountered in the joining area, and which is suitable for transmitting a relatively high shaft torque.

In accordance with a first embodiment of the invention, a rotor shaft assembly of a type used in a turbocharger for rotating about its axis to drive a compressor and supply compressed air to an internal combustion engine, is provided. The rotor shaft assembly has at least two parts bonded together by a metallurgical bond. First, the rotor shaft assembly comprises a steel shaft. The shaft is bonded to a turbine rotor comprising TiAl. The rotor is provided with a central hub that is adapted in its shape to accept the proximal end of the shaft in an axial manner. The turbine rotor is bonded to the proximal end of the shaft by a strong metallurgical bond, which is formed during the co-sintering of metal injection molded compacts of the shaft and rotor, which are axially mounted during sintering. Prior to co-sintering, a layer of a bonding material comprising a binder and fine metallic particles is interposed between the hub and shaft surfaces at the joint, which results in an improved metallurgical bond by at least solid state diffusion of the fine particles into the rotor and shaft. The degree of fit of the compacts and the respective compositions of the two compacts can be selected to provide a surface pressure of the rotor on the shaft due to relative shrinkage of the compacts during sintering.

Thus, in a second embodiment, there is provided a method for the cost-effective production of a turbine rotor assembly by separate metal injection molding of a shaft and a turbine rotor to form compacts, or "green" un-sintered parts. The shaft compact is assembled to the hub of the rotor as a layer of the bonding material is applied at the surfaces to be jointed. Co-sintering of the mounted assembly at an effective pressure and temperature provides a sintered, near-net rotor shaft assembly that has a strong metallurgical bond in which the parts become consolidated into a single unit.

In a third embodiment, the rotor is adapted to receive the shaft within an axial pocket disposed within the hub of the rotor, and one or more substantially enclosed axial air pockets are provided between the shaft and the rotor in the mounted position. The one or more axial pockets advantageously minimize heat transfer from the rotor to the shaft during operation of the turbocharger.

The turbine rotor assembly of the present invention is optionally machine finished to enhance dimensional accuracy, balance, and/or surface finish, by techniques that are well known to those of ordinary skill in the art.

BRIEF DESCRIPTION OF THE DRAWINGS

A more complete appreciation of the invention and many of the attendant advantages thereof will be readily obtained by reference to the following detailed description when considered in connection with the accompanying drawings, wherein.

DETAILED DESCRIPTION OF THE INVENTION

Figure 1:
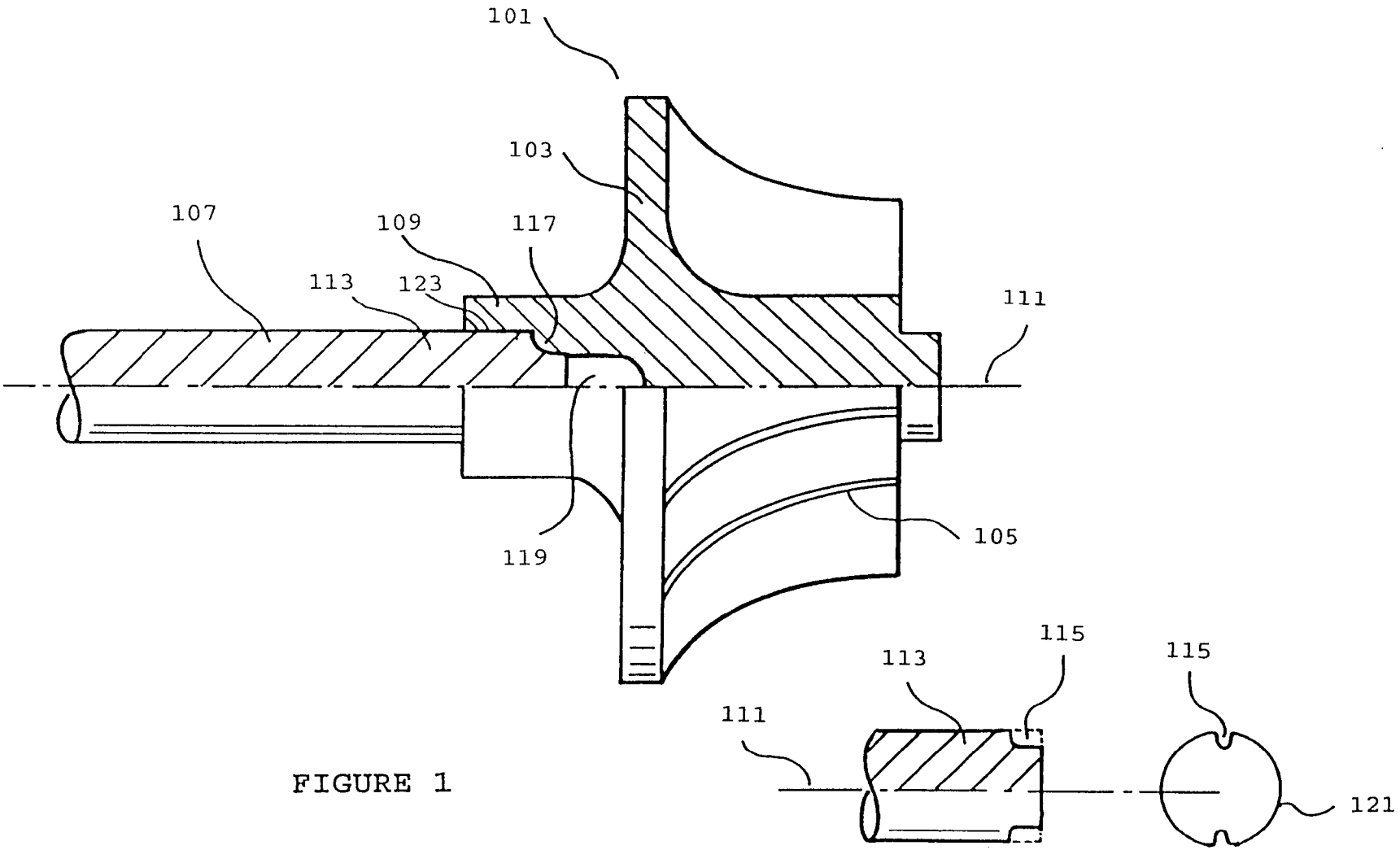
FIG. 1 shows a diagrammatic cross-section of the rotor shaft assembly of one embodiment of the present invention, and axial and longitudinal cross-sections of the proximal end of a shaft embodiment provided with an optional local notch.

A basic embodiment of the rotor shaft assembly of the present invention is shown in FIG. 1. The rotor shaft assembly 101 comprises a TiAl rotor 103, which comprises a plurality of vanes 105. The TiAl rotor 103 comprises a hub 109 disposed about the common axis of rotation 111 of the rotor shaft assembly. The interior surface 123 of the hub 109 is in intimate and positive connection with the proximal end 113 of metallic shaft 107. The hub 109 of rotor 103 is adapted for axial engagement of the proximal end 113 of steel shaft 107. In the specific embodiment of FIG. 1, the proximal end 113 of steel shaft 107 comprises a plurality of local notches 115, disposed radially, and preferably equidistantly, about the circumference 121 of the proximal end 113 of the steel shaft 107. In the mounted configuration, the local notches 115 engage corresponding lugs 117 within the hub 109 of the rotor 103.

Optionally, one or more cavities 119 are provided disposed between the interior surface of the hub 123 of rotor 103 and the surface of the proximal end 113 of the shaft 107. The cavity or cavities advantageously minimize heat transfer from the rotor, which is exposed to hot exhaust gases, to the shaft and its bearing.

The metal injection molded and sintered articles of the present invention are prepared by injection molding an admixture of metal particles in a binder. Parts prepared by injection molding an admixture of metal particles in a binder, but prior to debinding or sintering, are herein termed "compacts." Compacts are subjected to debinding and sintering steps, to remove binder and to increase metallic density, respectively, as is known in the art. Thus, the compact of a TiAl rotor, or a "rotor compact," is prepared by injection molding an admixture of TiAl particles and a binder. The TiAl intermetallic compound that is used is selected to be capable, in the finished densified form of withstanding the temperatures and stresses in an operating turbocharger, and resisting corrosion, but is not otherwise limited.

Although single phases of the specific compounds TiAl ("TiAl" is specifically used here in the sense of a chemical formula, as distinct from the use of the term herein elsewhere to denote titanium alloys comprising a TiAl intermetallic compound) and $Ti_3Al$ are brittle and weak, two-phase intermetallic TiAl is formed when aluminum comprises about 31–35% of the material by weight and Ti comprises substantially all of the remaining mass. The two-phase TiAl exhibits good ductility and strength, particularly at elevated temperatures.

Other metals are advantageously included in the TiAl metal powder used to injection mold the compact of the rotor of the present invention. Minor amounts of Cr, Mn, and V improve ductility, within the range of about 0.2% to about 4%. At amounts greater than about 4%, oxidation resistance and high temperature strength may be compromised. Ni, Ta, and W typically improve the oxidation resistance of TiAl. Si, in amounts between about 0.01% to about 1% improves creep and oxidation resistance. Suitable TiAl materials for use in the present invention include, but are not limited to, those disclosed in U.S. Pat. Nos. 5,064,112 and 5,296,055, US Publication No. 2001/0022946 A1, and U.S. Pat. No. 6,145,414.

The TiAl for injection molding is in the form of a micron-sized powder having a particle size of from about 1 μm to 40 μm. Preferably, the particle size is between about 1 μm and 10 μm. Methods for the production of fine powdered metals having a particle size of less than about 10 μm are known in the art, for example by plasma discharge spheroidization (Mer Corp.).

The TiAl powder is admixed with a binder for injection molding. The binder can be selected from among a wide variety of known binder materials, including, but not limited to, waxes, polyolefins such as polyethylenes and polypropylenes, polystyrenes, polyvinyl chloride, polyethylene carbonate, polyethylene glycol and microcrystalline wax. Aqueous binder systems of the type described in U.S. Pat. No. 5,332,537, and agar-based binders as described in U.S. Pat. Nos. 4,734,237, 5,985,208, and 5,258,155, are also suitable. The particular binder will be selected on the basis of compatability with powder components, and ease of mixing, molding and debinding. Thermoplastic binders are preferred.

A consideration in the selection of the binder is the degree of shrinkage of the rotor compact and steel shaft compacts required during sintering. Typically, about 15% shrinkage is obtained during the sintering of steel or TiAl components. However, the degree of shrinkage can be predetermined by the selection of binder, the ratio of binder to metal powder in the admixture, and the selection of debinding or sintering conditions. For example, U.S. Pat. No. 5,554,338 to Sugihara et al., the disclosure of which is incorporated herein in its entirety by reference, discloses binders suitable for the preparation of inner and outer compacts of a composite body, such that a tight fit of the compacts and a large contact area between the compacts is achieved by the predetermined choice of the relative size changes of the compacts during sintering.

A further consideration in the selection of the binder will avoid the use of any binder having a propensity to react with the titanium of the TiAl powder to form titanium carbide under debinding or sintering conditions. Titanium carbide may weaken jointing with the shaft.

Nothing herein should be construed to limit the rotor or shaft of the rotor shaft assembly of the present invention to rotors or shafts having a homogenous metal composition. Bi-metallic metal injection molding is known (e.g. U.S. Patent Application Publication No. US 2003/0012677 A1) whereby different metallic powder compositions admixed to binders are positioned in different portions of the mold to produce articles having a heterogenous distribution of different metals. Such methods are fully adaptable to the method and assembly of the present invention.

The shaft of the rotor shaft assembly of the present invention is also prepared from a metal powder admixed with a filler. The steel of the powder is not particularly limited except to have tensile strength and corrosion resistance commensurate with providing long service within a turbocharger. Stainless steel alloys, comprising iron and at least one other component to impart corrosion resistant, are preferred. Alloying metals can include at least one of chromium, nickel, silicon, and molybdenum. Suitable steels include precipitation hardened stainless steels such as 17-4 PH stainless steel, which is an alloy of iron, 17% chromium, 4% nickel, 4% copper, and 0.3% niobium and tantalum, which has been subjected to precipitation hardening. Low carbon steels, such as 316L, are preferred.

The TiAl rotor compact comprises a central hub adapted to axially accept the proximal portion of the shaft. The fit of the hub and shaft compacts is predetermined according to various factors. Compacts have limited tensile strength, precluding interference fitting. However, by selecting the metal powder particle size and composition, binder, and debinding and sintering conditions, according to principles known in the art, one of skill in the art can predetermine the rate and extent of shrinkage of the rotor and shaft compacts during sintering. See U.S. Pat. No. 5,554,338 to Sugihara et al. In particular, by predetermining the shrinkage and rates of shrinkage of the rotor and shaft compacts such that the rotor shrinks faster and/or to a greater extent than the shaft, a close fit is thereby provided between the shaft and rotor during sintering, which promotes formation of a strong metallurgical bond. These considerations inform design of the respective shaft and rotor mold dimensions. Preferably, the rotor and shaft compacts are a simple unstressed push fit.

The present inventors have surprisingly found that by providing both a bonding material layer as described herein, and also by matching the shrinkage rates of the rotor and shaft compacts to effect a continuous and tight fit of the parts during sintering, a bond of sufficient strength can be achieved between the dissimilar materials of a TiAl rotor and steel shaft of a turbocharger rotor shaft assembly.

Figure 2:
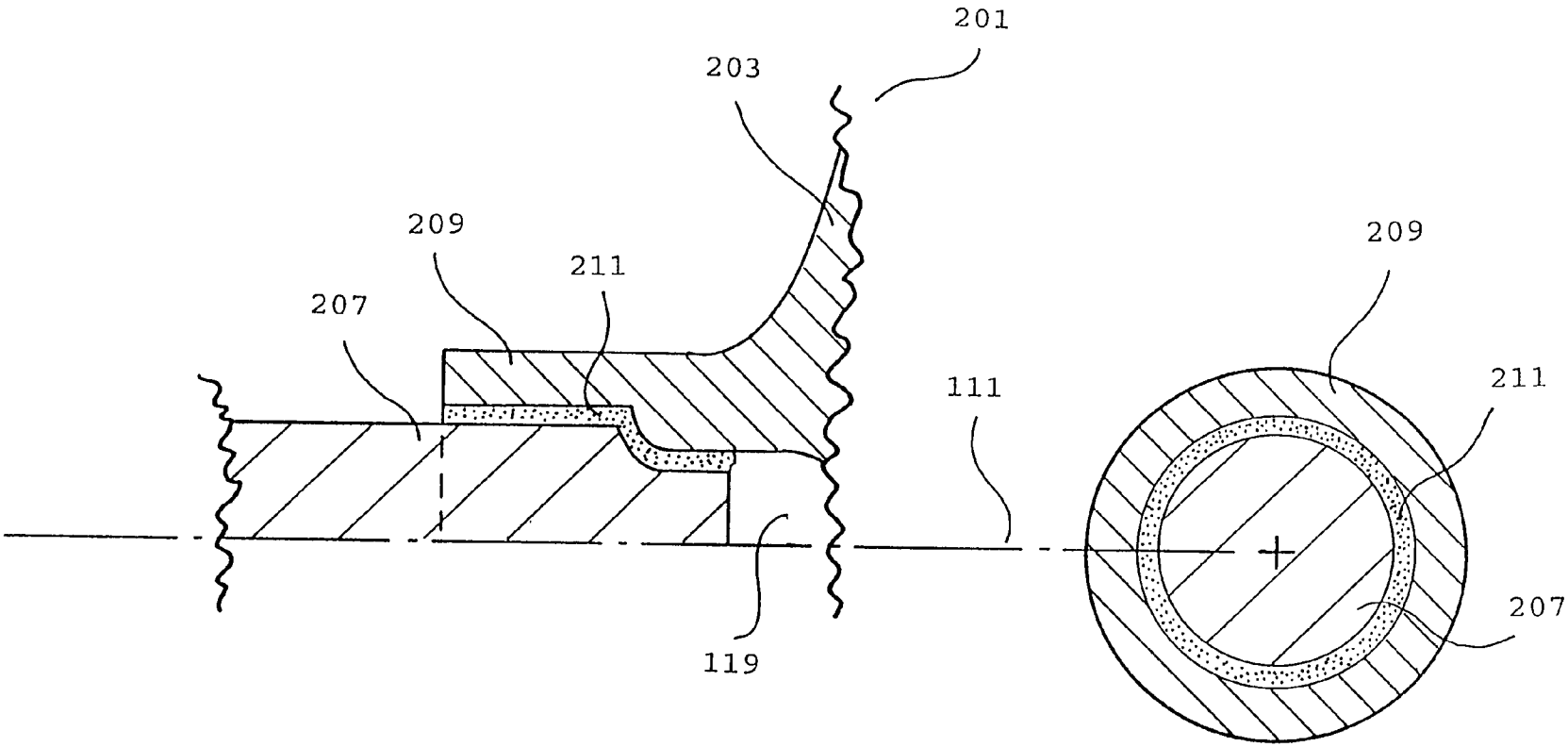
FIG. 2 shows cross sections of the jointing surfaces of the proximal end of the shaft mounted to the hub of the rotor with interposed bonding material prior to sintering.

Referring now to FIG. 2, there is shown an unsintered rotor shaft compact assembly 201. Specifically, there is shown a cross section of the jointing surfaces of the proximal end of the shaft compact 207 mounted to the hub 209 of the rotor compact 203 prior to sintering. The proximal end of the steel shaft compact 207 is axially mounted on rotational axis 111 to the hub 209 of the rotor compact with a layer of bonding material 211 interposed between. Preferably, a uniform and thin layer of bonding material is provided between the shaft compact 207 and the inner surface of the hub 209. The bonding material 211 comprises a fine metal powder and a binding agent. Preferably, in order to maximize contact between the bonding surfaces, the powder is a fine powder. The fine particles promote local bonding by providing local contact where surface roughness of the bonding surfaces would otherwise prevent it. Most preferably, the particles have a diameter of 10 μm or less. Fine powders are also advantageous because of their high surface energy and high diffusivity, which promote the formation of a diffusion bond during sintering. Optionally, the metal powder of the bonding material may comprise more than one metal. For example, Fe, Ni, and Cu, separately and in combination, typically improve bonding to compacts of austenitic precipitation hardenable steel. Vanadium powder may promote bonding to TiAl. See U.S. Pat. No. 5,314,106.

It is preferable, but not essential to the formation of a bond that the metal of the bonding material be compatible with the TiAL and/or steel of the rotor and shaft. The bond comprises contributions from solid-state diffusion bonding and, where some liquid phase of the metals occurs, fusion bonding. The term "metallurgical bond" is used herein to denote a bond comprising solid-state diffusion bonding and, optionally, fusion bonding. See U.S. Pat. No. 6,551,551 to Gegel and Ott.

The binder of the bonding material is not particularly limited and both water-based and wax-based binders, as listed herein above, are effective.

After mounting of the rotor and shaft compacts with a bonding material interposed at the bonding surface, the mounted compacts are debound to remove binder. The product of debinding is a "brown" rotor shaft assembly. Debinding is typically carried out at a temperature of less than about 300° C. Preferably, the debinding temperature is between about 200° C. and 250° C. A solvent, including water, can be used to debind at lower temperatures, the solvent being selected to be compatible with the binder.

Sintering of the brown rotor shaft assembly is typically carried out at a temperature from about 1200° C. to about 1430° C. for a period from about 45 min to about 2 hours. The specific sintering conditions depend upon the specific binders used, the shape and size of the sintered object, and the degree of densification required. Preferably, to minimize oxidation, the sintering is performed in a partial vacuum or under at least a 50% hydrogen atmosphere. Most preferably, sintering is performed under a 90% hydrogen atmosphere. While nitrogen and argon minimize oxidation, hydrogen is preferred because it is known to also improve densification.

The sintering process yields a jointed rotor shaft assembly in near-net form. Typically, additional finishing processes, which are well known to those of ordinary skill in the art, are preferred. The rotor shaft assembly can be machined, for example, to improve the balance of the assembly for high-speed operation, or the surface may be improved by any of a number of known techniques, such as ball-peening and the like.

Figure 3:
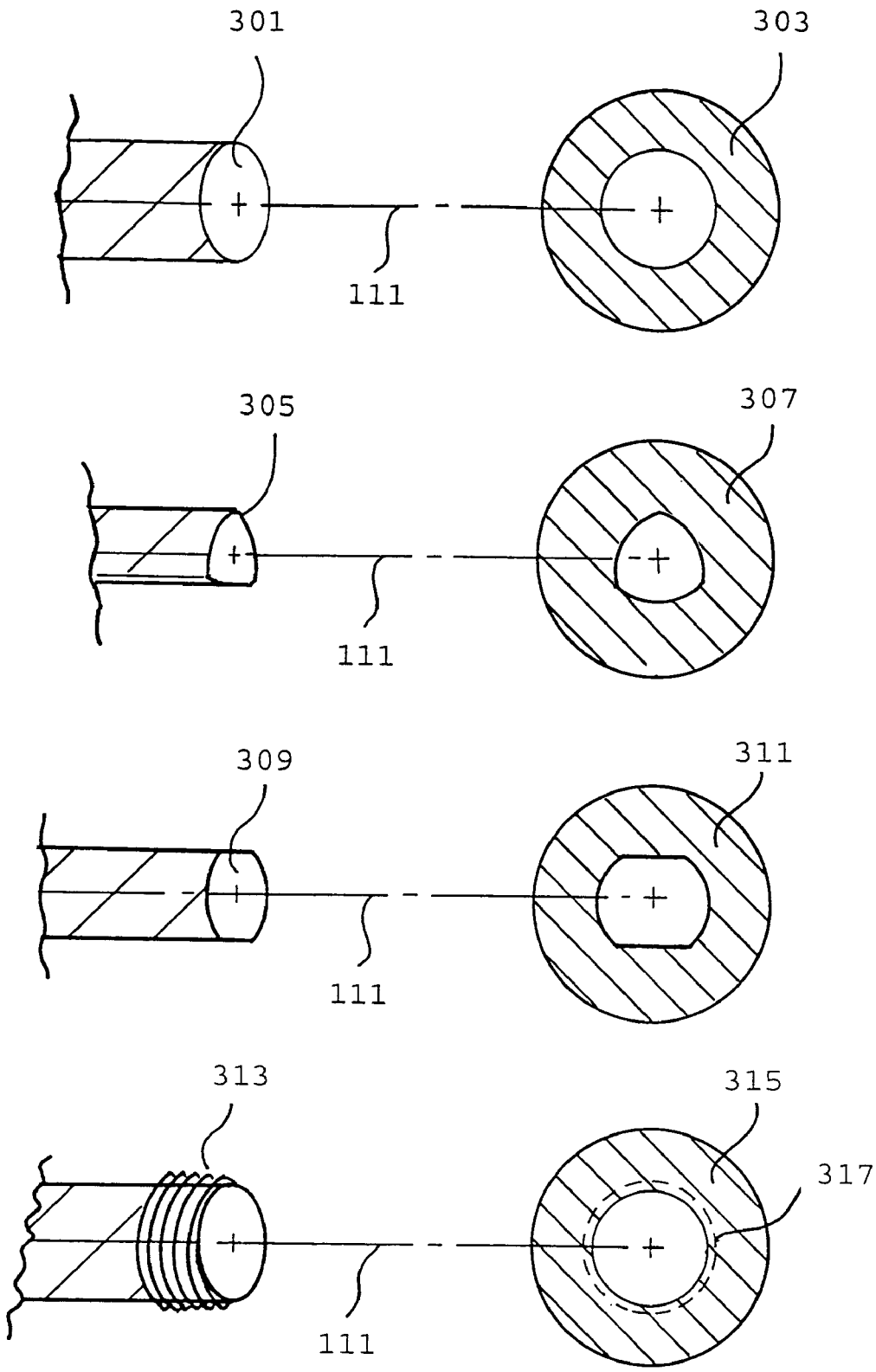
FIG. 3 shows four exemplary cross-sections of proximal shaft ends and rotor hubs adapted to their respective shafts.

Referring now to FIG. 3, there are shown several cross-sections of optional proximal shaft ends (301, 305, 309 and 313) for mounting to rotor hubs (303, 307, 311, and 315), which are similarly adapted to their respective shafts. The means to adapt the hub to the proximal end of the shaft is not limited, except for the requirements of providing adequate bonding surface, and maintaining the balance of the rotor shaft assembly for high-speed stability. Thus, inherently balanced or shaft end shapes having a high degree of symmetry are preferred. While a cylindrical proximal end to the shaft can be used, a stronger resistance to separation of the rotor from the shaft can be achieved by the use of a proximal shaft end shape that prevents independent rotation of the shaft and rotor. Preferably, the proximal end of the shaft is knurled (301), polygonal 305, a flatted shaft 309, comprises a local notch 113, or has a threaded shaft 315 comprising a threaded portion 313 corresponding to a threaded portion 317 of the hub 315. These, and many other, means to adapt the hub of the rotor to mount a suitably adapted shaft, within the design constraints of a particular application, to produce a balanced rotor shaft assembly having hindered independent rotation of the shaft and rotor, will be readily apparent to those of skill in the art. For example, the present invention also contemplates a means for axially mounting the hub and shaft in which an axial projection of the hub is engaged by a cup-shaped recess in the proximal end of the shaft, such that the rotor projection is circumferentially engaged by the shaft.

Various modifications and changes may be made by those having ordinary skill in the art without departing from the spirit and scope of this invention. Therefore, it is to be understood that the illustrated embodiments of the present invention have been set forth only for the purposes of example, and that they should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements that are literally set forth, but all equivalent structure material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

The claims are thus to be understood to include what is specifically illustrated and described above, what is conceptually equivalent, what can be obviously substituted and also what incorporates the essential idea of the invention.

Now that the invention has been described,

What is claimed is:

1. A process for axially bonding the hub (109) of a titanium aluminide (TiAl) turbine rotor (103) to a steel shaft (107) of a rotor shaft assembly (101) of a type used in a turbocharger for rotating about its axis (111) to drive a compressor, said process comprising:

(a) axially mounting a compact (207) of said shaft (107), comprising a steel powder admixed with a binder, to the hub (209) of a compact (203) of said rotor (103), comprising a TiAl powder admixed with a binder, with a bonding material (211) comprising a binder admixed with fine metallic powder disposed between said proximal end of said shaft compact (207) and said hub (209) to form a mounted compact (201), and (b) debinding and sintering said mounted compact (201), whereby said rotor (103) and said shaft (107) are bonded to form said rotor shaft assembly (101).

2. The process of claim 1, wherein said rotor compact (203) is selected to have a hub (209) that has an inner diameter that shrinks more upon sintering than does the diameter of said shaft compact (207).

3. The process of claim 1, wherein said sintering is performed from about 1200° C. to about 1430° C. for a period from about 45 min to about 2 hours.

4. The process of claim 1, wherein said powders have a particle size of from about 1 μm to 40 μm.

5. The process of claim 4. wherein said powders have a particle size of from about 1 μm to 10 μm.

6. The process of claim 1, wherein said binder is selected from the group consisting of waxes, polyolefin, polyethylene, polypropylene, polystyrene, polyvinyl chloride, polyethylene carbonate, polyethylene glycol, and microcrystalline wax, or a mixture thereof.

7. The process of claim 1, wherein said debinding is carried out at temperature of between about 200° C. and 250° C.

8. The process of claim 1, wherein a metallurgical bond is formed between the hub (109) of the titanium aluminide (TiAl) turbine rotor (103) and the steel shaft (107).

* * * * *